US009702133B2

(12) United States Patent
Hornsby et al.

(10) Patent No.: US 9,702,133 B2
(45) Date of Patent: Jul. 11, 2017

(54) FLUID DISPENSER

(71) Applicant: S. C. Johnson & Son, Inc., Racine, WI (US)

(72) Inventors: James Russell Hornsby, St. Louis, MO (US); Joseph Lee McGowan, St. Charles, MO (US)

(73) Assignee: S. C. Johnson & Son, Inc., Racine, WI (US)

( * ) Notice: Subject to any disclaimer, the term of this patent is extended or adjusted under 35 U.S.C. 154(b) by 812 days.

(21) Appl. No.: 13/950,757

(22) Filed: Jul. 25, 2013

(65) Prior Publication Data

US 2013/0333103 A1 Dec. 19, 2013

Related U.S. Application Data

(62) Division of application No. 12/535,381, filed on Aug. 4, 2009, now Pat. No. 8,522,370.

(60) Provisional application No. 61/087,543, filed on Aug. 8, 2008.

(51) Int. Cl.
*E03D 9/02* (2006.01)
*E03D 9/00* (2006.01)

(52) U.S. Cl.
CPC ..... *E03D 9/005* (2013.01)

(58) Field of Classification Search
CPC ... E03D 9/005; E03D 9/032; E03D 2009/028; E03D 2009/026
USPC ..... 4/223
See application file for complete search history.

(56) References Cited

U.S. PATENT DOCUMENTS

| | | | |
|---|---|---|---|
| 3,178,070 | A | 4/1965 | Leland |
| 3,946,448 | A | 3/1976 | Sioufy |
| 4,183,105 | A | 1/1980 | Womack |
| 4,216,553 | A | 8/1980 | Haberle |
| 4,670,916 | A | 6/1987 | Bloom |
| 4,777,670 | A | 10/1988 | Klinkhammer et al. |

(Continued)

FOREIGN PATENT DOCUMENTS

| | | |
|---|---|---|
| JP | 62-149859 | 4/1989 |
| JP | H03228718 A | 10/1991 |

(Continued)

OTHER PUBLICATIONS

International Search Report and Written Opinion, PCT/US2009/004501, Nov. 10, 2009.

*Primary Examiner* — Huyen Le

(57) ABSTRACT

A device for spraying an inner surface of a wall of an enclosure with a fluid is disclosed. The device includes a reservoir for the fluid, a nozzle assembly through which the fluid can be sprayed on the inner surface of the wall of the enclosure, a fluid conduit in fluid communication with the reservoir and the nozzle, a pump for delivering fluid from the reservoir through the fluid conduit and to the nozzle when the pump assembly is activated, and a controller in electrical communication with the pump wherein the controller executes a stored program to activate and deactivate the pump. The nozzle assembly includes a nozzle which directs the fluid in a fluid path, and the nozzle assembly further includes a deflection shield that is dimensioned to contact and redirect fluid in the fluid path, and the nozzle assembly further includes mounting structure for attaching the nozzle near the inner surface of the wall of the enclosure. The flow off of the deflector shield is laminar.

16 Claims, 11 Drawing Sheets

(56) References Cited

U.S. PATENT DOCUMENTS

| | | | | |
|---|---|---|---|---|
| 5,022,098 | A | 6/1991 | Brower | |
| 5,024,382 | A | 6/1991 | Shook et al. | |
| 5,862,532 | A | 1/1999 | Cain | |
| 6,029,286 | A | 2/2000 | Funk | |
| 6,178,564 | B1 | 1/2001 | Leonard et al. | |
| 6,230,334 | B1 | 5/2001 | Camp et al. | |
| 6,347,414 | B2 | 2/2002 | Contadini et al. | |
| 6,694,536 | B1 | 2/2004 | Haygreen | |
| 6,739,479 | B2 | 5/2004 | Contadini et al. | |
| 6,820,821 | B2 | 11/2004 | Linstedt et al. | |
| 7,021,494 | B2 | 4/2006 | Mazooji et al. | |
| 7,322,052 | B2 | 1/2008 | Alexander | |
| D591,824 | S | 5/2009 | Leonard et al. | |
| 2004/0050959 | A1 | 3/2004 | Mazooji et al. | |
| 2005/0133540 | A1* | 6/2005 | Hornsby | B05B 15/006 222/333 |
| 2007/0136937 | A1 | 6/2007 | Sawalski et al. | |
| 2007/0234470 | A1 | 10/2007 | Sawalski et al. | |
| 2007/0240252 | A1 | 10/2007 | Leonard et al. | |
| 2008/0272200 | A1 | 11/2008 | Ordiway et al. | |
| 2009/0000016 | A1 | 1/2009 | Sawalski et al. | |
| 2009/0249533 | A1* | 10/2009 | Sawalski | E03D 9/005 4/223 |

FOREIGN PATENT DOCUMENTS

| | | | |
|---|---|---|---|
| JP | H05222757 | A | 8/1993 |
| JP | 200070797 | A | 3/2000 |
| JP | 20050527362 | | 9/2005 |
| JP | 20090520896 | | 5/2009 |
| WO | 9966139 | A1 | 12/1999 |
| WO | 9966140 | A1 | 12/1999 |

* cited by examiner

FLUID DISPENSER

CROSS-REFERENCES TO RELATED APPLICATIONS

This application is a divisional application of U.S. patent application Ser. No. 12/535,381 filed Aug. 4, 2009, which claims priority based on U.S. Provisional Application No. 61/087,543 filed Aug. 8, 2008.

STATEMENT REGARDING FEDERALLY SPONSORED RESEARCH

Not Applicable.

BACKGROUND OF THE INVENTION

1. Field of the Invention

The invention relates to devices, systems and methods for dispensing, distributing or delivering a substance. More particularly, the invention relates to a device and method for dispensing a liquid (e.g., a cleaner, disinfectant, deodorizer, etc.). More particularly, the invention relates to dispensing a liquid in an enclosed area or defined perimeter, including in situations in which a human operator is present or not, and/or is not required or desired. In one embodiment, the invention is especially well suited for automatically cleaning toilet bowls of the type typically found in homes. In this embodiment, the invention relates to an automatic and/or manual toilet bowl cleaning device where the inner surface of the toilet bowl can be cleaned around the entire circumference of the toilet bowl. The device includes a nozzle that effectively delivers a cleaner around the circumference of a toilet bowl. The nozzle directs the flow of the cleaner.

2. Description of the Related Art

Toilet bowls require care to prevent the buildup of unsightly deposits, to reduce odors, and to prevent bacteria growth. Traditionally, toilet bowls have been cleaned, deodorized, and disinfected by manual scrubbing with a liquid or powdered cleaning and sanitizing agent. This task has required manual labor to keep the toilet bowl clean.

In order to eliminate the detested manual scrubbing, various toilet bowl cleaner dispensers have been proposed. One type of dispenser comprises a solid block or solid particles of a cleansing and freshening substance that is suspended from the rim of a toilet bowl in a container that is placed in the path of the flushing water. U.S. Pat. No. 4,777,670 shows an example of this type of toilet bowl cleaning system. Typically, a portion of the solid block is dissolved in the flush water with each flush, and the flush water having dissolved product is dispensed into the toilet bowl for cleaning the bowl.

Other toilet bowl cleaning systems use a liquid cleaning agent that is dispensed into a toilet bowl. For example, U.S. Pat. Nos. 6,178,564 and 6,230,334, and PCT International Publication Nos. WO 99/66139 and WO 99/66140 all disclose cleansing and/or freshening devices capable of being suspended from the rim of a toilet bowl for introducing liquid active substances from a bottle into the flushing water with each flush. In these under the toilet rim devices, the liquid active substances are delivered downward from a reservoir to a dispensing plate that is supported by a base that is suspended from the toilet bowl rim. The device is suspended from the toilet rim such that the flow of flush water from the toilet contacts the dispensing plate during a flush. The flush water carries the liquid active substances that are on the dispensing plate into the toilet bowl to clean and freshen the toilet.

Other toilet bowl dispensers use an aerosol deodorizing and/or cleaning agent that is dispensed into a toilet bowl through a conduit attached to the toilet bowl rim. For example, U.S. Pat. No. 3,178,070 discloses an aerosol container mounted by a bracket on a toilet rim with a tube extending over the rim; and U.S. Pat. Nos. 6,029,286 and 5,862,532 disclose dispensers for a toilet bowl including a pressurized reservoir of fluid, a conduit connected to the source of fluid, and a spray nozzle which is installed on the toilet rim.

One disadvantage with these known toilet rim dispensing devices is that these devices may only apply the deodorizing and/or cleaning agent to one location in the toilet water or a limited area in the toilet water or on the inner surface of the toilet bowl. As a result, the cleaning of the inner surface of the toilet bowl may be limited to an area of the toilet bowl near the device.

U.S. Patent Application Publication Nos. 2007/0136937, 2007/0234470, 2007/0240252, 2008/0017762, and 2009/0000016 (which are incorporated herein by reference) are owned by the owner of the current invention. These publications set forth, among others, an automatic and/or manual toilet bowl cleaning device where the inner surface of the toilet bowl is cleaned around the entire circumference of the toilet bowl.

In one example embodiment illustrated in U.S. 2007/0136937, the downstream end of a fluid supply conduit terminates in a nozzle capable of spraying the cleaning fluid outwardly onto the inner surface of the toilet bowl at locations below the toilet waterline, and/or locations at the toilet waterline, and/or locations above the toilet waterline, and/or locations under the toilet rim. The nozzle is attached by a mounting clip at a location near the rim of the toilet bowl. The mounting clip can house a proximity or motion sensor that detects the presence of a person. Manual delivery of the cleaning fluid from a fluid supply container to the fluid supply conduit can be achieved by pressing a manual activation button that is in electrical communication with a control circuit that turns on an electrically driven pump that delivers the cleaning fluid into the fluid supply conduit and into the spray nozzle. Automatic delivery of the cleaning fluid from a fluid supply container to the fluid supply conduit can also be achieved pressing an activation button that is in electrical communication with a control circuit that controls on an electrically driven pump. Immediately after the user presses the activation button, fluid delivery occurs at selected time intervals (e.g. every eight hours). The proximity sensor that is in electrical communication with the control circuit can stop initiation of a spray cycle if a person is near the toilet bowl.

In view of the advances in the art provided by the devices of U.S. Patent Application Publication Nos. 2007/0136937, 2007/0234470, 2007/0240252, 2008/0017762 and 2009/0000016 even further improvements to this technology would be beneficial to consumers.

SUMMARY OF THE INVENTION

The present invention meets the foregoing need for a device for spraying a fluid on an inner surface of a wall of an enclosure, such as a toilet bowl.

In one aspect, the invention provides a device for spraying an inner surface of a wall of an enclosure, such as a toilet with a fluid. The device includes a reservoir for the fluid, a nozzle assembly through which the fluid can be sprayed on the inner surface of the wall of the enclosure, a fluid conduit in fluid communication with the reservoir and the nozzle, a pump for delivering fluid from the reservoir through the fluid conduit and to the nozzle when the pump assembly is activated, and a controller in electrical communication with the pump wherein the controller executes a stored program to activate and deactivate the pump. The nozzle assembly includes a nozzle which directs the fluid in a fluid path, and the nozzle assembly further includes one or more deflection shields that are dimensioned to contact and redirect fluid in the fluid path, and the nozzle assembly further includes mounting structure for attaching the nozzle near the inner surface of the wall of the enclosure. The flow off of the deflector shield is laminar. The controller can activate the pump when a manual actuator is actuated. In one form, the force of the fluid flowing into the nozzle assembly and out of the nozzle can effect rotation of the nozzle. The nozzle assembly can further include a motor to effect rotation of the nozzle. The fluid dispensed from the nozzle does not pass above a plane defined by a top surface of a toilet bowl of the toilet.

In another aspect of the invention, the invention provides a device for spraying an inner surface of a wall of an enclosure, such as a toilet bowl, with a fluid. The device includes a reservoir for the fluid, a nozzle assembly including a nozzle through which the fluid can be sprayed on the inner surface of the wall of the enclosure, a fluid conduit in fluid communication with the reservoir and the nozzle, a pump for delivering fluid from the reservoir through the fluid conduit and to the nozzle when the pump is activated, and a controller in electrical communication with the pump, the controller executing a stored program to activate and deactivate the pump, and a vent assembly in fluid communication with an interior space of the reservoir. The nozzle assembly includes mounting structure for attaching the nozzle near the inner surface of the wall of the enclosure. The vent assembly includes a valve wherein the valve opens by negative pressure that develops as fluid is withdrawn from the reservoir and closes when the pressure in the reservoir has equalized. The valve can be an actuator assist valve. The controller can activate the pump based on a scheduled spraying time stored in the controller. The controller can activate the pump when a manual actuator is actuated. In one form, fluid flowing into the nozzle assembly and out of the nozzle effects rotation of the nozzle. The nozzle assembly can further include a motor to effect rotation of the nozzle.

In yet another aspect of the invention, the invention provides a device for spraying an inner surface of a wall of a toilet bowl with a fluid. The device includes a reservoir for the fluid, a nozzle assembly including a nozzle through which the fluid can be sprayed on the inner surface of the wall of the toilet bowl, a fluid conduit in fluid communication with the reservoir and the nozzle, a pump for delivering fluid from the container through the fluid conduit and to the nozzle when the pump is activated, a sensor for detecting unseating of a person from the toilet, and a controller in electrical communication with the pump, the sensor, and a source of electricity. The nozzle assembly includes mounting structure for attaching the nozzle near the inner surface of the wall of the toilet bowl. The controller executes a stored program to (i) monitor electrical signals from the sensor to determine when a person unseats from the toilet, and (ii) if the controller determines that a person has unseated from the toilet, activate the pump for a pump cycle time for delivering fluid from the reservoir through the fluid conduit and to the nozzle. The sensor can be an infrared sensor that emits an actuation signal upon a predetermined change in light intensity. The sensor can be a pressure sensor disposed on the nozzle assembly that senses the force of a person seated on the toilet. The controller can activate the pump when a manual actuator is actuated. In one form, the force of the fluid flowing into the nozzle assembly and out of the nozzle can effect rotation of the nozzle. The nozzle assembly can include a motor to effect rotation of the nozzle.

In still another aspect of the invention, the invention provides a device for spraying an inner surface of a toilet bowl with a fluid. The device includes a reservoir for the fluid, a nozzle assembly including a nozzle through which the fluid can be sprayed on the inner surface of the toilet bowl, a pump for delivering fluid from the reservoir through the fluid conduit and to the nozzle when the pump is activated, and a controller in electrical communication with the pump. The controller executes a stored program to activate and deactivate the pump. The nozzle assembly includes mounting structure for attaching the nozzle near the inner surface of the toilet bowl. The nozzle assembly further includes a housing connected to the mounting structure, and the housing contains the pump and the controller. The controller can activate the pump based on a scheduled spraying time stored in the controller. The controller can activate the pump when a manual actuator is actuated. In one form, the force of the fluid flowing into the nozzle assembly and out of the nozzle can effect rotation of the nozzle.

The advantages of the present invention will become apparent from the following description. In that description reference will be made to the accompanying drawings which form a part thereof, and in which there is shown by way of illustration example embodiments of the invention. The example embodiments do not limit the full scope of the invention.

BRIEF DESCRIPTION OF THE DRAWINGS

Like reference numerals will be used to refer to like parts from Figure to Figure in the following detailed description.

DETAILED DESCRIPTION OF THE INVENTION

Figure 1:
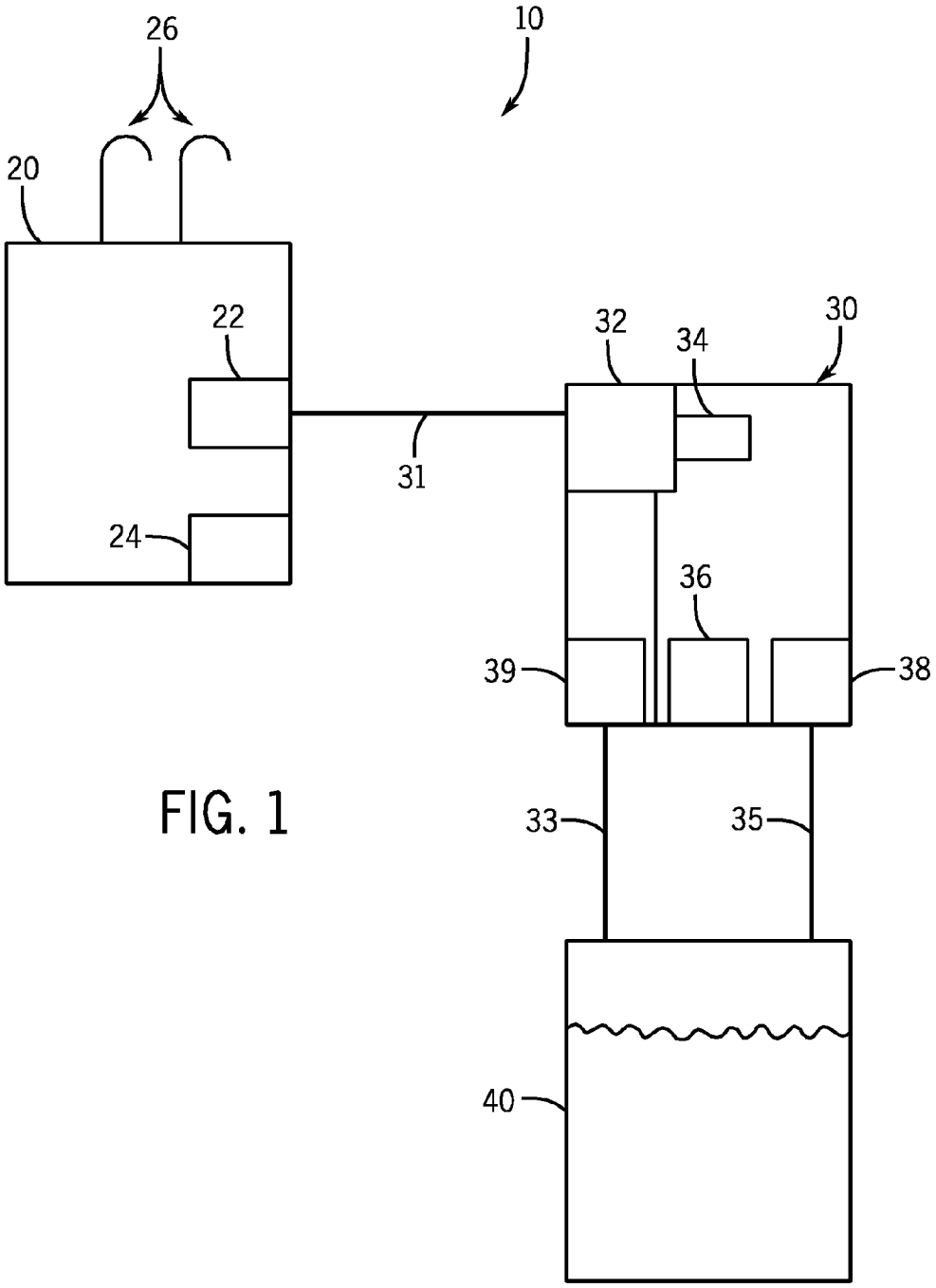
FIG. 1 is a schematic view of an automated sprayer assembly in accordance with a non-limiting embodiment of the present invention.

FIG. 1 is a schematic view of an exemplary automated sprayer assembly. As illustrated, in some embodiments, automated sprayer assembly 10 may include a nozzle assembly 20, a pump assembly 30, and a fluid reservoir 40. Generally, a portion of the automated sprayer assembly 10, such as for example the nozzle assembly 20, or nozzle assembly 20 and pump assembly 30, may be provided with a mounting structure such that that the portion of the automated sprayer assembly 10 may be mounted in an enclosure and/or partial enclosure, such as for example a toilet bowl, and actuated to initiate dispensing an amount of fluid from the nozzle assembly 20.

In some embodiments, nozzle assembly 20 may include a nozzle 22, actuating sensor 24, and a mounting structure 26. Generally, nozzle assembly 20 may be sized and shaped such that it may be fixedly mounted, via mounting structure 26, within the interior of a toilet bowl, such as for example directly below the top rim of a toilet bowl. An exemplary design is described in U.S. Des. Pat. No. D591,824. In one embodiment, nozzle assembly 20 may be configured such that when mounted, fluid dispensed from nozzle 22 may cover substantially the entire interior toilet bowl wall. In this regard, nozzle 22 may be configured on the nozzle assembly 20 such that the force of fluid flowing into the nozzle assembly 20 and out of nozzle 20 effects rotation of the nozzle 22. Alternatively, rotation of nozzle 22 may be motor driven. In a further alternative, nozzle 22 may be stationary, and configured to deliver a spray pattern that covers substantially the entire interior toilet bowl wall.

In one embodiment, nozzle 22 may be further configured to prevent fluid dispensed from nozzle 22 to pass above a plane defined by the top surface of the toilet bowl. Such controlled delivery may be achieved, for example, appropriate configuration of the spray pattern of nozzle 22 and/or by the addition of a deflector shield 25 (see FIG. 6). Surprisingly, it is discovered that the use of a deflector shield 25 (see FIG. 6) provides the benefit of a laminar flow exiting the nozzle 22. In some embodiments, nozzle 22 may be any type of nozzle suitable for controlled delivery of fluid, such as for example, a fan nozzle.

Nozzle assembly 20 may further include an actuation sensor 24. Generally, actuation sensor 24 may comprise any sensing device that accommodates selective actuation of the automated sprayer assembly 10. For example, in one embodiment, actuation sensor 24 comprises an infrared (IR) sensor. As is known, IR sensors may emit an actuation signal upon a predetermined change in light intensity, such as that which may occur in a toilet bowl when an individual seats/unseats themselves on/from a toilet. As a further example, sensor 24 may comprise a pressure sensor disposed on nozzle assembly 20 such that it may sense the force of an individual seated on the toilet. Alternatively, any type of suitable sensor may be employed.

In some embodiments, pump assembly 30 may be coupled to the nozzle assembly 20 such that both of the nozzle assembly 20 and pump assembly 30 are positioned within the toilet bowl. Alternatively, pump assembly 30 may be coupled to fluid reservoir 40 such that the pump assembly 30 and the fluid reservoir 40 comprise a unitary structure. In a further alternative, pump assembly 30 may be a standalone structure.

Pump assembly 30 may include a pump 32, motor 34, power source 36, vent system 38, and control circuitry 39. To accommodate fluid flow between the components of the automated sprayer assembly 10, in some embodiments, pump assembly 30 may further include one or more fluid pathways. For example, pump assembly 30 may include a first fluid pathway 31 providing fluid communication between the nozzle 22 and an outlet of pump 32, a second fluid pathway 33 providing fluid communication between reservoir 40 and an inlet of pump 32, and third fluid pathway 35 providing fluid communication between the vent system 38 and fluid reservoir 40.

Pump 32 may be any conventional pump, such as for example, a piston pump, gear pump, peristaltic pump, a dual reciprocating pump and the like. In one embodiment, components of a gear box assembly, driven by motor 34, may operate to drive the pump 32. Generally, operation of the pump 32 draws fluid from the fluid reservoir 40 via pathway 33 and to the nozzle assembly 20 via pathway 31. Alternatively, some embodiments of the present invention device 10 do not have a pump 32. In such embodiments, it may be desirable to provide a pressuring fluid reservoir 40 instead.

Motor 34 may comprise a direct current motor. Alternatively, any suitable motor for driving pump 32 may be employed. In one embodiment, motor 34 may include a rotating drive shaft that is operably coupled to one or more components of a gear box assembly, the gear box assembly being coupled to the pump 32 such that operation of the motor 34 drives pump 32, which draws fluid from the reservoir 40 and to the nozzle assembly 20. Alternatively, any suitable linkage may be provided between the pump 32 and motor 34.

In some embodiments, vent system 38 may comprise a valve configured such that it opens by negative pressure that develops as fluid is withdrawn from the reservoir 40, and closes when the pressure in the reservoir has equalized sufficiently to alleviate any negative pressure. In some embodiments, vent system may comprise an actuator assist valve. Alternatively, any other type of valve suitable for aspiration of air into the reservoir may be used, such as for example, a check-ball valve, duckbill valve, and the like.

In certain embodiments, control circuitry 39 may be accommodated in pump assembly 30. Control circuitry 39 may comprise an integrated circuit board and any or all of a speaker, LED, and an actuation switch coupled to, for example, a push button actuator. Control circuitry 39 may be in electronic communication with the motor 34 and actuation sensor 24. The control circuitry 39 may be further electrically coupled to the power supply via, for example, battery terminals in the battery compartments.

In one embodiment, control circuitry 39 may comprise timing circuitry to, for example, delay activation of the automated sprayer assembly 10. In other embodiments, timed release actuation or actuation at a set or selected time may be provided by a suitable programmed or programmable timer or time release device and/or, in some embodiments, actuation may be controlled remotely.

In one embodiment, power source 36 may comprise a DC power supply, such as for example, one or more batteries stored in one or more battery compartments. In one embodiment, the battery compartments comprise isolated or separate battery compartments, that are spaced away from and generally downwardly from the pump 32 and motor 34. The battery compartments may be accessible from an exterior of the pump assembly 30 and include a removable battery cover which facilitates user access the battery compartment.

In one embodiment, power supply may comprise battery two AA batteries. Alternatively, any number of batteries of any type may be employed.

In some embodiments, fluid reservoir 40 may be positioned in a location which is remote relative to the nozzle assembly 20, or remote relative to both of the nozzle assembly 20 and the pump assembly 30. In one embodiment, fluid reservoir 40 may include a mounting structure which facilitates mounting of the fluid reservoir to an exterior of the toilet bowl and/or toilet tank. Alternatively, the fluid reservoir 40 may be configured such that it may stand on a surface immediately surrounding the toilet, such as on a bathroom floor.

In some embodiments, when a user wishes to spray the interior toilet bowl walls with cleansing fluid, the user may simply depress the push button actuation switch at the front of the sprayer 10. This may signal timing circuitry to begin a countdown delaying spraying for a predetermined time. This affords the user time to unseat themselves from the toilet before actuation of the motor 32. Initially depressing the switch may also send a pulsed tone to the speaker and flash the LED for warning the user of the impending operation of the sprayer.

In other embodiments, the sprayer 10 may be automatically actuated upon receiving an actuation signal from actuation sensor 24. For example, when a user unseats themselves from the toilet, or upon the detection of a flush, or some other signal that indicates the user has completed use of the toilet, the actuation sensor may send a signal to the control circuitry 39. This may signal timing circuitry to begin a countdown delaying spraying for a predetermined time. Additionally, this may send a pulsed tone to the speaker and flash the LED for warning the user of the impending operation of the sprayer.

In some embodiments, unless cancelled by the user, the spray cycle may begin automatically at the expiration of the countdown. The motor 34 is then energized which simultaneously drives components of the pump such that the pump draws fluid from the fluid reservoir 40 through the pathway 31. This reduces the level of cleanser in the bottle, creating a negative pressure in the bottle, which opens the vent system 38 to aspirate the fluid reservoir 40 and allow more fluid to be drawn from the fluid reservoir 40 during the spray cycle.

The motor may continue to be energized until the expiration of a second countdown performed by the timing circuit, automatically initiated by the timer. At that point the motor is deenergized which shuts down the pump 32.

Figure 2:
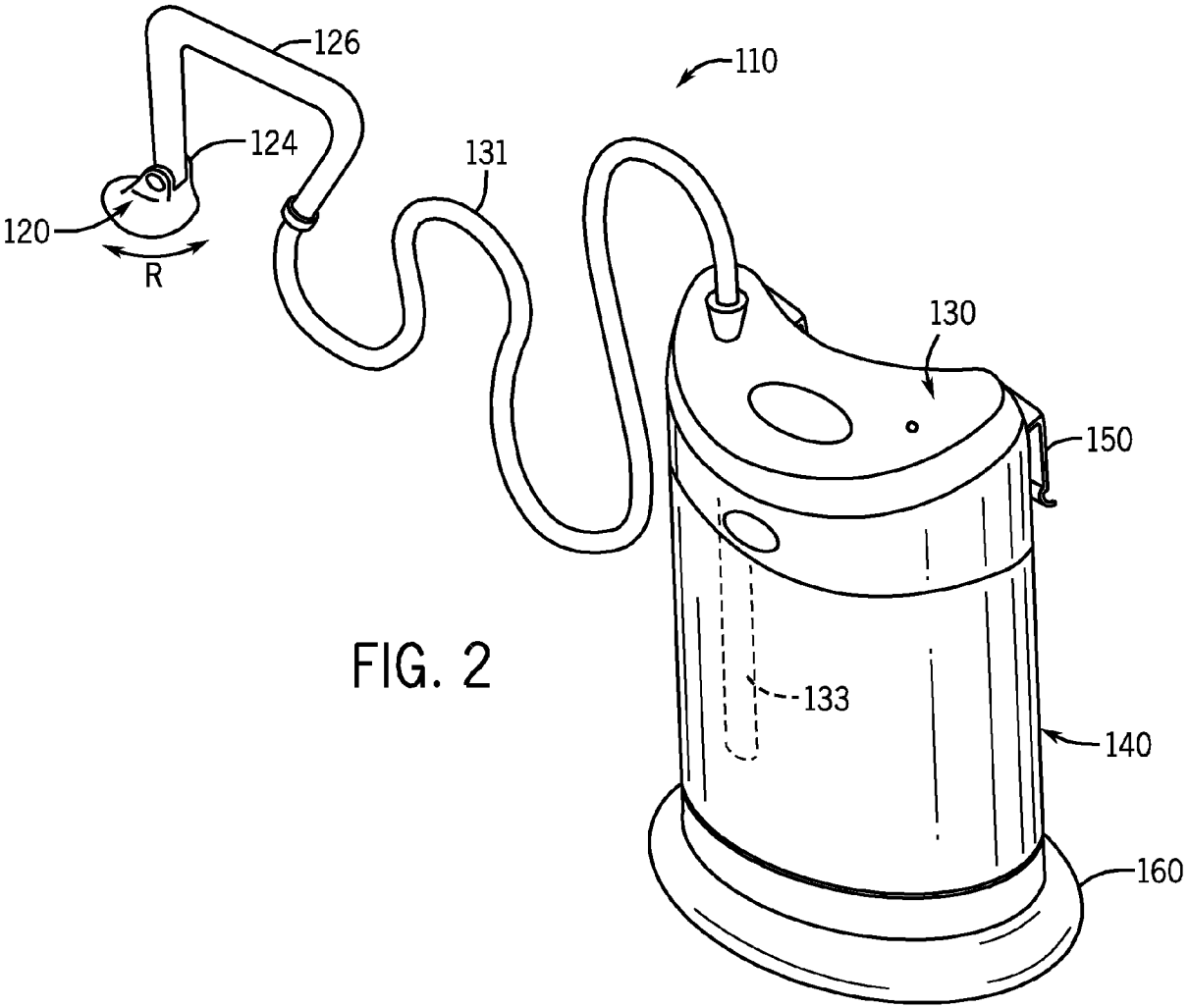
FIG. 2 is a front right perspective view of another embodiment of an automated sprayer assembly in accordance with the present invention.
Figure 3:
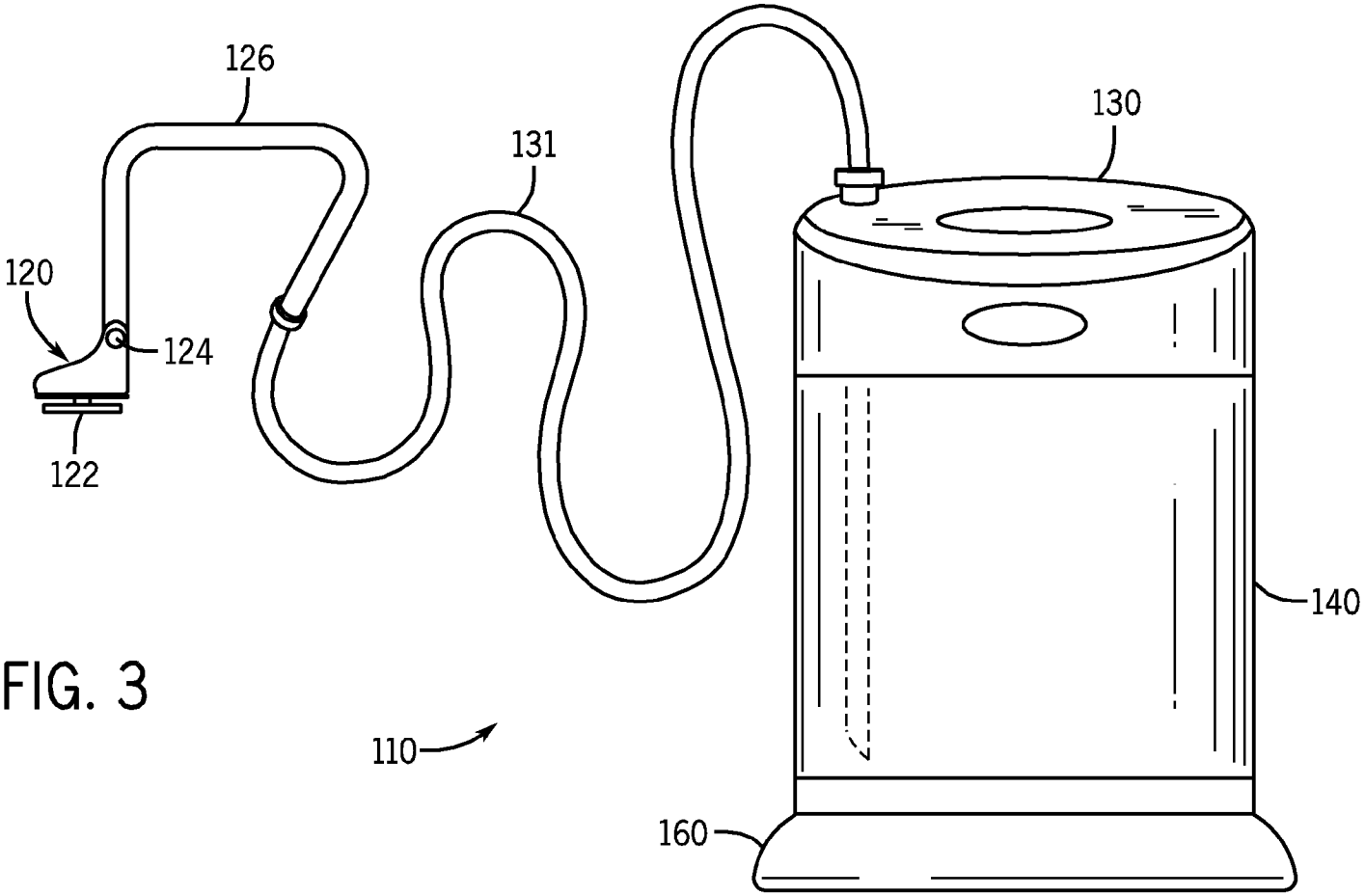
FIG. 3 is a front view of the sprayer assembly of FIG. 2.
Figure 4:
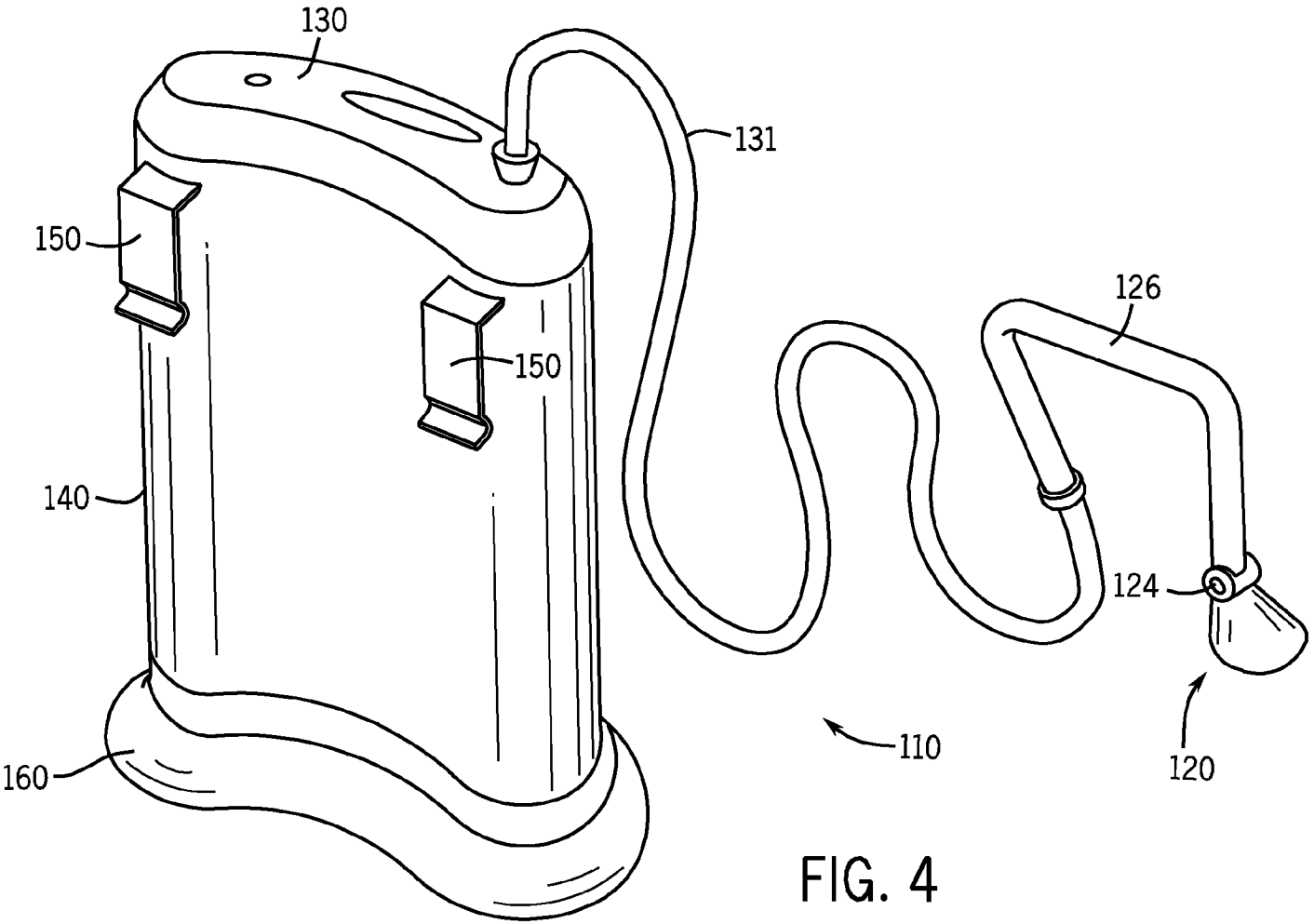
FIG. 4 is a rear perspective view of the sprayer assembly of FIG. 2.

FIGS. 2-4 illustrate an alternative automated fluid sprayer 110 according to some embodiments. As illustrated, automated fluid sprayer 110 may include a nozzle assembly 120, a pump assembly 130, and a fluid reservoir 140. Nozzle assembly 120 may include may include a rotating nozzle 122 and a mounting structure 126. Nozzle assembly 120 may include may a pivot pin 124 for pivoting the rotating nozzle 122 in directions R in FIG. 2. As shown, nozzle assembly 120 may be configured such that it may be fixedly mounted, via mounting structure 126, on the upper rim of a toilet bowl such that the nozzle 122 is within the interior of the toilet bowl. Nozzle assembly 120 may be in fluid communication with the pump assembly 130 via fluid pathway 131.

Pump assembly 130 may be coupled to fluid reservoir 140 such that the pump assembly 130 and the fluid reservoir 140 comprise a unitary structure. In some embodiments, the unitary structure may be mounted via mounting structures 150 to a toilet bowl and/or toilet tank (not shown). Alternatively, the unitary structure may include a removable floor stand 160 for facilitating placement of the unitary structure on the floor immediately adjacent the toilet.

Figure 5:
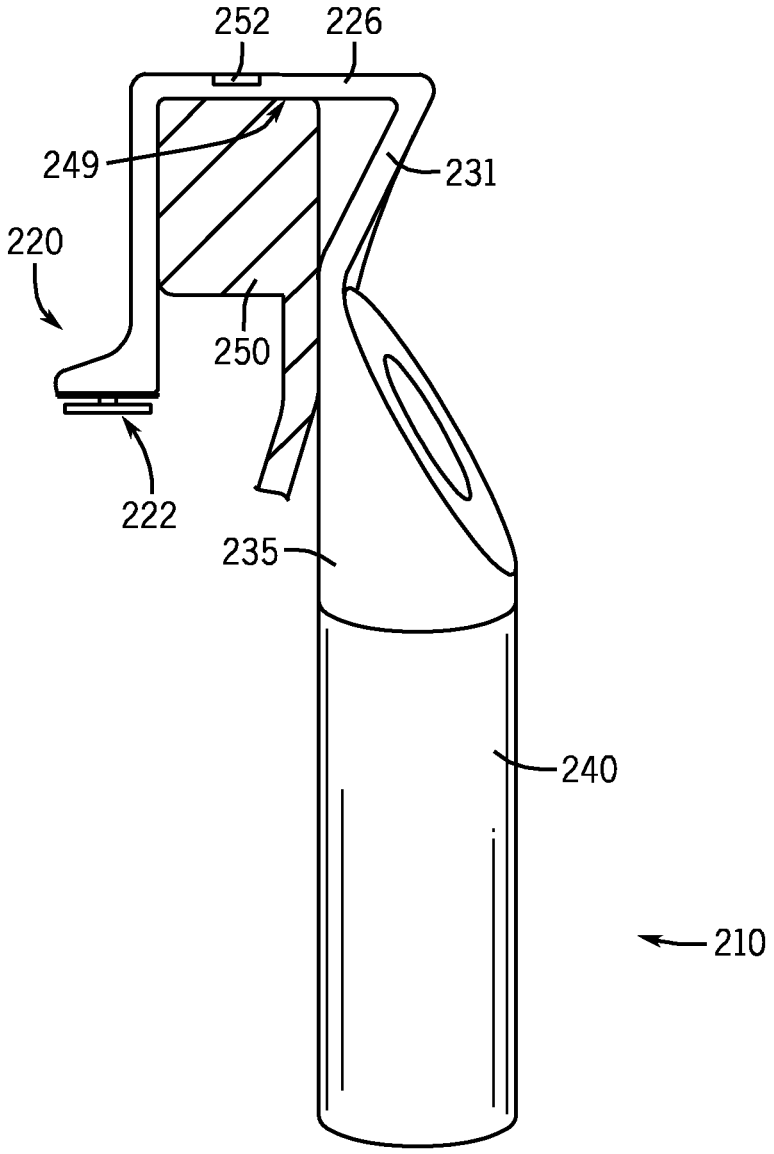
FIG. 5 is a perspective view of another embodiment of an automated sprayer assembly in accordance with the present invention.

FIG. 5 shows another alternative automated fluid sprayer 210 according to some embodiments. As illustrated, automated fluid sprayer 210 may include a nozzle assembly 220, a pump assembly in a housing 235, and a fluid reservoir 240. Nozzle assembly 220 may include may include a rotating nozzle 222 and a mounting structure 226. As shown, nozzle assembly 220 may be configured such that it may be fixedly mounted, via mounting structure 226, on the upper rim 249 of a toilet bowl 250 such that the nozzle 222 is within the interior of the toilet bowl 250. Nozzle assembly 220 may be in fluid communication with the pump assembly via fluid pathway 231. The housing 235 may be coupled to fluid reservoir 240 such that the housing 235 and the fluid reservoir 140 comprise a unitary structure. The unitary structure may be mounted via mounting structure 226 to toilet bowl 250 and/or a toilet tank (not shown). Mounting structure 126 of FIGS. 2-4 is also mounted over a toilet bowl 250 in a similar manner as mounting structure 226. The top of the mounting structure 226 can include a pressure sensor 252 that senses when a user is sitting on a toilet seat and when a user has unseated from the toilet seat.

Use of a Deflector Shield

Figure 6:
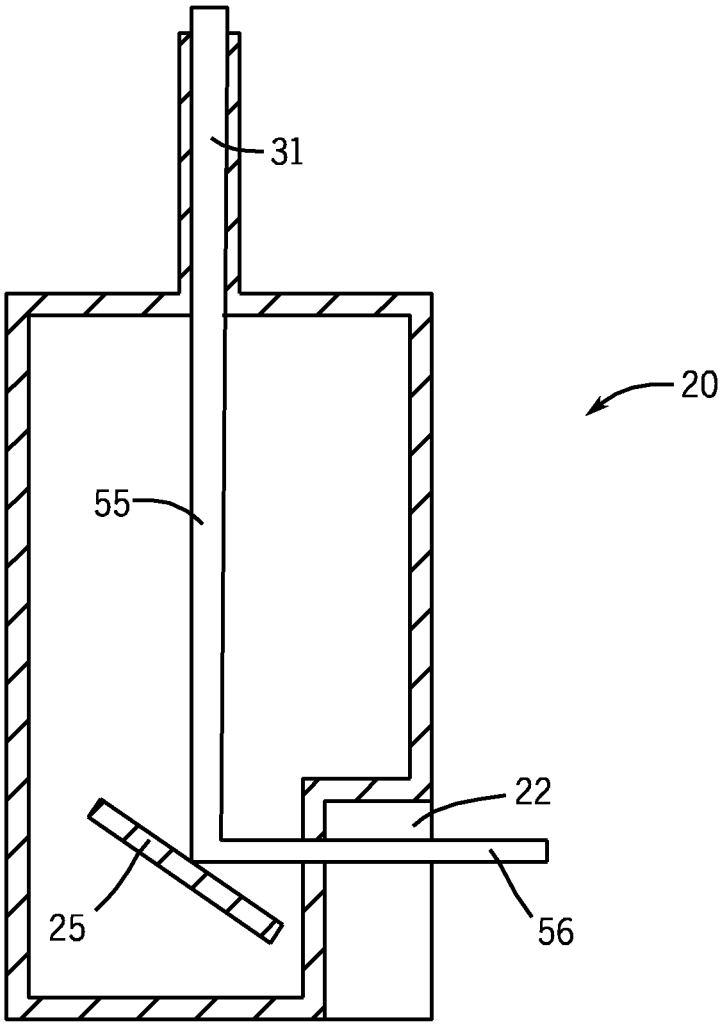
FIG. 6 is a cross-sectional view of a nozzle assembly for use with the automated sprayer assembly of FIGS. 2-4.

In certain non-limiting embodiments of the present invention, the present invention spray device provides a spray pattern using a deflector shield or other deflector surface to directing liquid/fluid from the device. FIG. 6 shows an exemplary embodiment of a nozzle assembly 20. The nozzle assembly 20 comprises a deflector shield 25 that may direct fluid 55 that is provided from the first fluid pathway 31 to the nozzle assembly 20 in one or more directions through the nozzle 20 in a coherent, laminar flow 56 and towards the inner surface of a toilet bowl (not shown) or other enclosure (not shown).

Without wishing to be limited by theory, it is thought that there is a resultant laminar fluid flow from the deflector shield 25 that may be directed towards the inner surface of an enclosure. It is thought that the direction of laminar flow, towards the inner surface of the enclosure, as compared to the mere expulsion of fluid from an orifice, provides a resultant spray having particles that are not extremely fine particles. It is surprisingly discovered by the inventors that a dispersion of relatively fine particles is not well suited for automatic toilet cleaning purposes because such particles are often subject to undesirable drifting, and such fine particles, which may be acceptable for the delivery of fragrance, are relatively unsuitable for delivering cleanser composition to the inner surface of an enclosure (such as a toilet bowl).

Further, it is thought that by directing a turbulent stream towards an enclosure, the resultant contact between the turbulent stream and the surface of the enclosure may create a splash which may cause additional considerations for producers/manufacturers as opposed to a laminar flow which provides a relatively low amount of splash.

In another embodiment, a plurality of the deflector shields 25 can also be arranged with their axis parallel to the central longitudinal axis of the first fluid pathway 31. This arrangement or structure also provides for a coherent or laminar flow for the reduction of turbulence, and any turbulence reducing structure or method may be adapted to provide for a coherent or laminar flow or stream from the nozzle assembly 20, including, for example, star-shaped chambers, stacks or bundles of materials, foam plugs, shaped chambers or chamber walls. Creating a coherent or laminar stream also makes it possible to extend the distance through which the fluid or liquid can effectively and efficiently be delivered.

Use of a Motor

There exist particular systems wherein the rotation of the nozzle may be caused by the flow of fluid. A non-limiting example of such a system is described in U.S. Pat. No. 5,024,382. Such a system is noted to be well-suited for high-pressure spray applications. In such a system, the rate of rotation appears to be highly correlated to the flow rate and other flow characteristics. By comparison in a system wherein the spray and delivery of the fluid and/or composition is relatively critical, it is discovered that it may be desirable to control any rotational characteristics of the spray nozzle in order to control the level of deposition/amount of product or composition that is deposited onto the surface of the enclosure. This may be of particular importance to a device that provides a cleaning composition to the inner surface of an enclosure such as a toilet bowl because there may be an optimal amount of coverage that is needed for effective cleansing.

A suitable motor may be used to provide rotation to the nozzle assembly. A suitable means may be used to control the rate of rotation, such of the nozzle assembly.

User Detection

In some embodiments, the present invention may include one or more sensors to detect the presence of a user. Certain freshening systems for use in lavatories detect the presence of a user as a trigger to dispense freshening composition or fragrance, etc. An exemplary system is the Sense N' Spray device that is produced by the S.C. Johnson & Son, Co. (Racine, Wis.). It is discovered that such a system may not be best suited for the present invention automatic toilet cleaning device because the process of actively dispensing a composition in the presence of a user is actually undesirable in the present invention system because it may not be desired to spray the user with composition and/or fragrance.

The present invention addresses this unexpected obstacle by providing an exemplary embodiment wherein the embodiment comprises a sensor system that provides feedback to a control unit in the present invention device such that the device does not discharge any composition when a user is detected to be nearby, or in some other embodiments, seated on or otherwise engaged with, the toilet bowl.

A sensor for preventing accidental or unwanted discharge of fluid or composition from the device may be selected from proximity sensors, light sensors, sound sensors, pressure sensors, vibration sensors, motion sensors, and combinations thereof. In one version of the invention, the means for delivering fluid from the container is a pump, and the device further includes a control system in electrical communication with the pump and the sensor and a source of electricity, wherein the control system executes a stored program to initiate a cycle in which the pump delivers fluid from the container through the fluid conduit and to the fluid delivery device. The enclosure can be a toilet bowl, the sensor can be a flush sensor, and the control circuit can execute the stored program to initiate the cycle after the flush sensor senses a flush. The control circuit can include a timer circuit which automatically initiates the cycle at a set time period after the flush.

Looking at FIGS. 7-11, there is shown an example embodiment of another automated sprayer 610 according to the invention. The sprayer 610 is especially well suited for supplying a liquid to the fluid pathway 231 of the sprayer 610.

Figure 7:
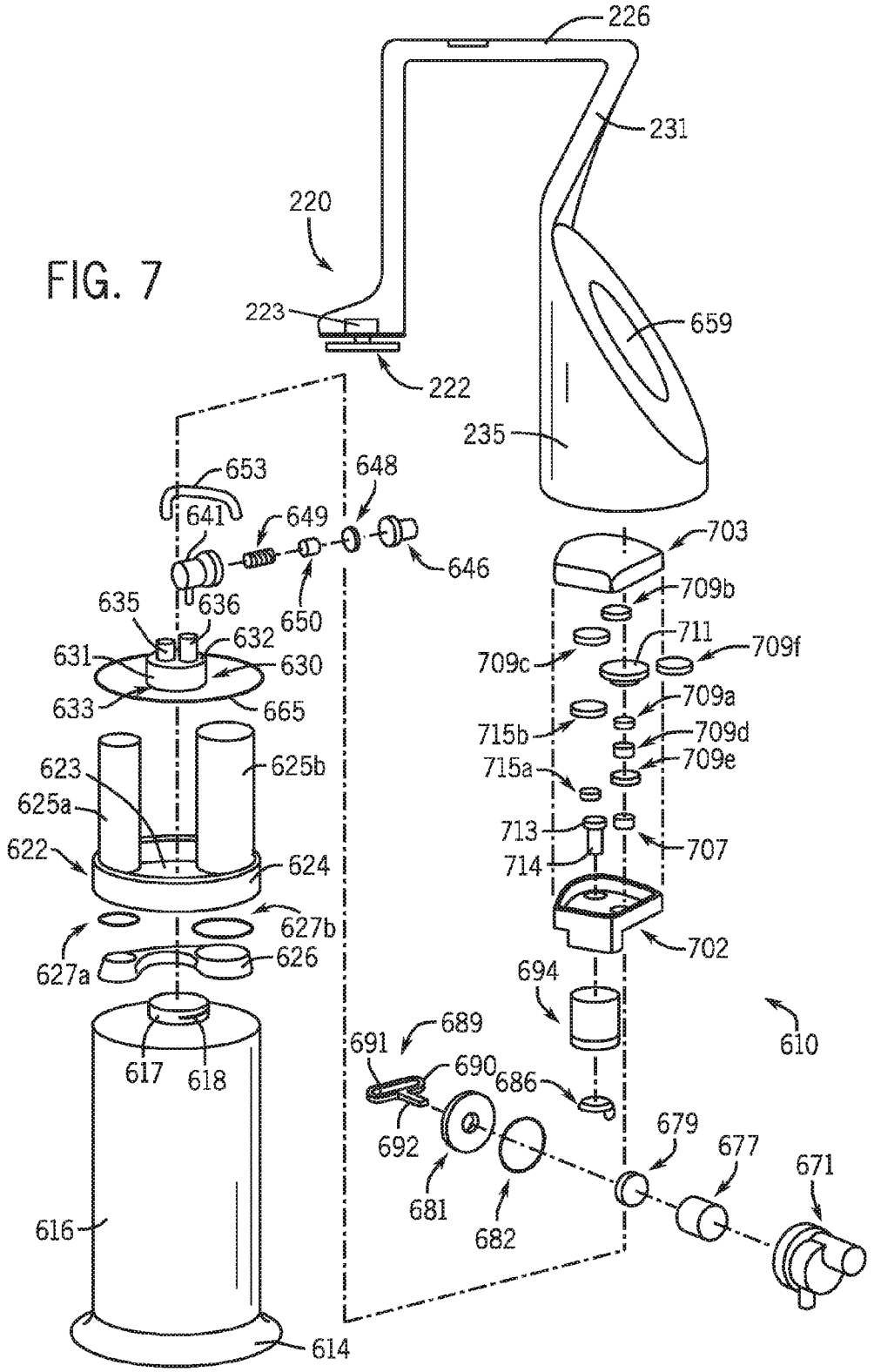
FIG. 7 is an exploded perspective view of another automated sprayer according to the invention.

Referring to FIG. 7, the sprayer 610 includes a bottle 616 having a hollow neck 617 with external threads 618 and a removable floor stand 614. The bottle 616 is suitable for containing a liquid for cleaning and/or freshening and/or disinfecting a hard surface such as a wall of a toilet bowl. The bottle 616 may be supplied with a closure (not shown) that is screwed onto the neck 617. The closure keeps the liquid contained in the bottle 616 before the bottle 616 is installed in the sprayer 610. The bottle 616 is typically formed from a suitable polymeric material such as polyethylene, polypropylene, or polyethylene terephthalate. The threads may be either the so-called "conventional" threads or the so-called "bayonet"-type threads.

Looking at FIG. 7, the sprayer 610 includes a lower housing section 622 with a bottom wall 623 and an outer wall 624 that extends upward from the bottom wall 623. The lower housing section 622 includes upwardly extending hollow battery compartments 625*a*, 625*b* for containing batteries as an energy source for the sprayer 610. Any number of batteries of any type may be employed. A removable cover 626 provides access to the battery compartments 625*a*, 625*b* so that a user can replace discharged batteries. The cover 626 can be secured to the bottom wall 623 of the lower housing section 622 by a suitable fastener such as a screw, and O-rings 627*a*, 627*b* provide a watertight seal between the cover 626 and the bottom wall 623 of the lower housing section 622. The lower housing section 622 can be formed from a polymeric material such as polyethylene or polypropylene. Looking at FIG. 7, the sprayer 610 also includes an upper housing section 235 (also shown in FIG. 5) which can be formed from a polymeric material such as polyethylene or polypropylene. The upper housing section 235 mates with the lower housing section 622.

The sprayer 610 also includes a bottle coupler 630 having an outer wall 631, and a top wall 632, and an open end 633 opposite the top wall 632. The outer wall 631 and the top wall 632 define a generally cylindrical interior space in the bottle coupler 630. The bottle coupler 630 includes a first tubular conduit 635 and a second tubular conduit 636. The first tubular conduit 635 defines a liquid passageway in fluid communication with the interior space in the bottle coupler 630. The second conduit 636 defines an air vent passageway in fluid communication with the interior space in the bottle coupler 630. The bottle coupler 630 is mounted in a hole in the bottom wall 623 of the lower housing section 622. The inner surface of the outer wall 631 of the bottle coupler 630 includes threads that are dimensioned to matingly engage the external threads 618 on the neck 617 of the bottle 616 when the neck 617 of the bottle 616 is screwed into the interior space in the bottle coupler 630. Optionally, the bottle coupler 630 mates with a dip tube that is provided in the bottle 616.

Figure 11:
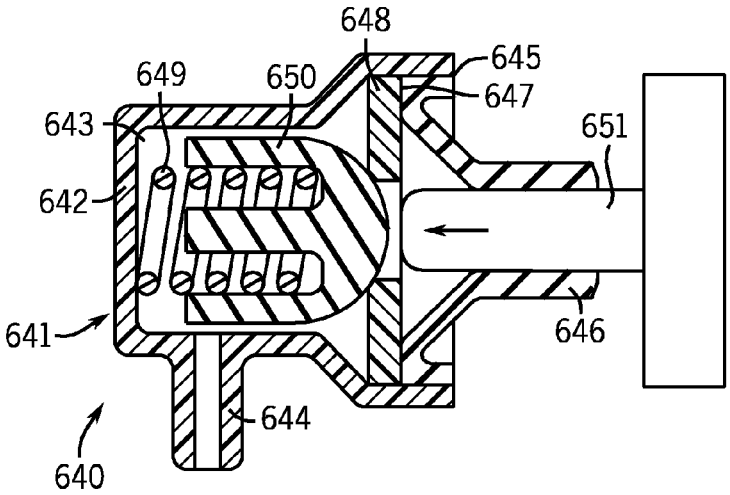
FIG. 11 is a cross-sectional view of an air vent valve suitable for use with an automated sprayer in accordance with the invention.

Referring now to FIGS. 7 and 11, the sprayer 610 also includes an actuator assist check valve 640 that provides for venting of the bottle 616 from the atmosphere. Air replaces the volume of liquid drawn into the pump of the sprayer, and prevents the bottle 616 from collapsing. The check valve 640 includes a valve housing 641 having an outer wall 642 that defines an interior space 643 of the check valve 640. A first conduit 644 provides an air flow path into the interior space 643. The check valve 640 has an open end 645, and has a second conduit 646 with a generally funnel shaped end that is press fit into the open end 645. An annular valve seat 647 is provided on the funnel shaped end of the second conduit 646. The check valve 640 includes a flexible annular valve seal 648 that seats against the annular valve seat 647 when the check valve 640 is in the normally closed position shown in FIG. 11. The check valve 640 includes a helical compression spring 649 that biases an umbrella shaped valve element 650 against the valve seal 648 to keep the valve seal 648 in the normally closed position. In an example form of the check valve 640, the valve seal 648 can be formed from an elastomeric material, the spring can be formed from carbon or stainless steel, and the remaining components of the check valve 640 can be formed from a polymeric material such as polyethylene or polypropylene.

The first conduit 644 of the check valve 640 can be press fit into the second conduit 636 of the bottle coupler 630 such that the first conduit 644 is placed in fluid communication with the interior space in the bottle coupler 630 and the bottle 616 which is mounted to the bottle coupler 630. Negative pressure can build in the bottle 616 when liquid is withdrawn from the bottle 616. The negative pressure overcomes the biasing force of the spring 649 and/or the sealing force of the annular valve seal 648 against the annular valve seat 647 such that atmospheric air flows between the annular valve seal 648 and the annular valve seat 647, into the interior space 643 of the check valve 640, through the first conduit 644, into the interior space in the bottle coupler 630 and into the bottle 616 to provide venting.

In some cases, the fluid used in the bottle 616 may leave a sticky residue on the umbrella shaped valve element 650, thereby causing inconsistency in valve operation, and preventing correct air flow into the bottle 616. For example, the sticky residue may cause the umbrella shaped valve element 650 to stick in an open position and allow leaks and/or stick in a closed position such that fluid or air is prevented from passing through. The sticky residue may be caused, for example, by direct contact between the umbrella shaped valve element 650 and fluid from the bottle 616 that has seeped up into the valve 640 or by contact with vapors from the fluid in the reservoir.

The valve 640 may further include a mechanical actuator, such as a mechanical tab, rod, or lever, etc., that may open or initiate the opening of the valve 640. Once the opening of the valve 640 has been initiated using the mechanical actuator, the vacuum created by the reservoir may maintain the valve 640 in an open position, or continue opening the valve 640, such that air may flow from the second conduit 646 to the first conduit 644. The mechanical actuator, in one embodiment, may be a push rod 651 (see FIG. 11) generally near the second conduit 646. The push rod 651 may have a normal position with one end protruding from the second conduit 646 of the valve 640. In one embodiment, the push rod 651 may be activated by a solenoid of the sprayer 610. Upon actuation of the solenoid, the push rod 651 contacts the umbrella shaped valve element 650. Contact between the push rod 651 and the umbrella shaped valve element 650 may unseat, or initiate the unseating of, the umbrella shaped valve element 650 from the valve seat 647. The resulting vacuum created in the bottle 616 may cause the umbrella shaped valve element 650 to remain unseated or continue to become unseated from the valve seat 647, thereby opening the valve 640.

Figure 9:
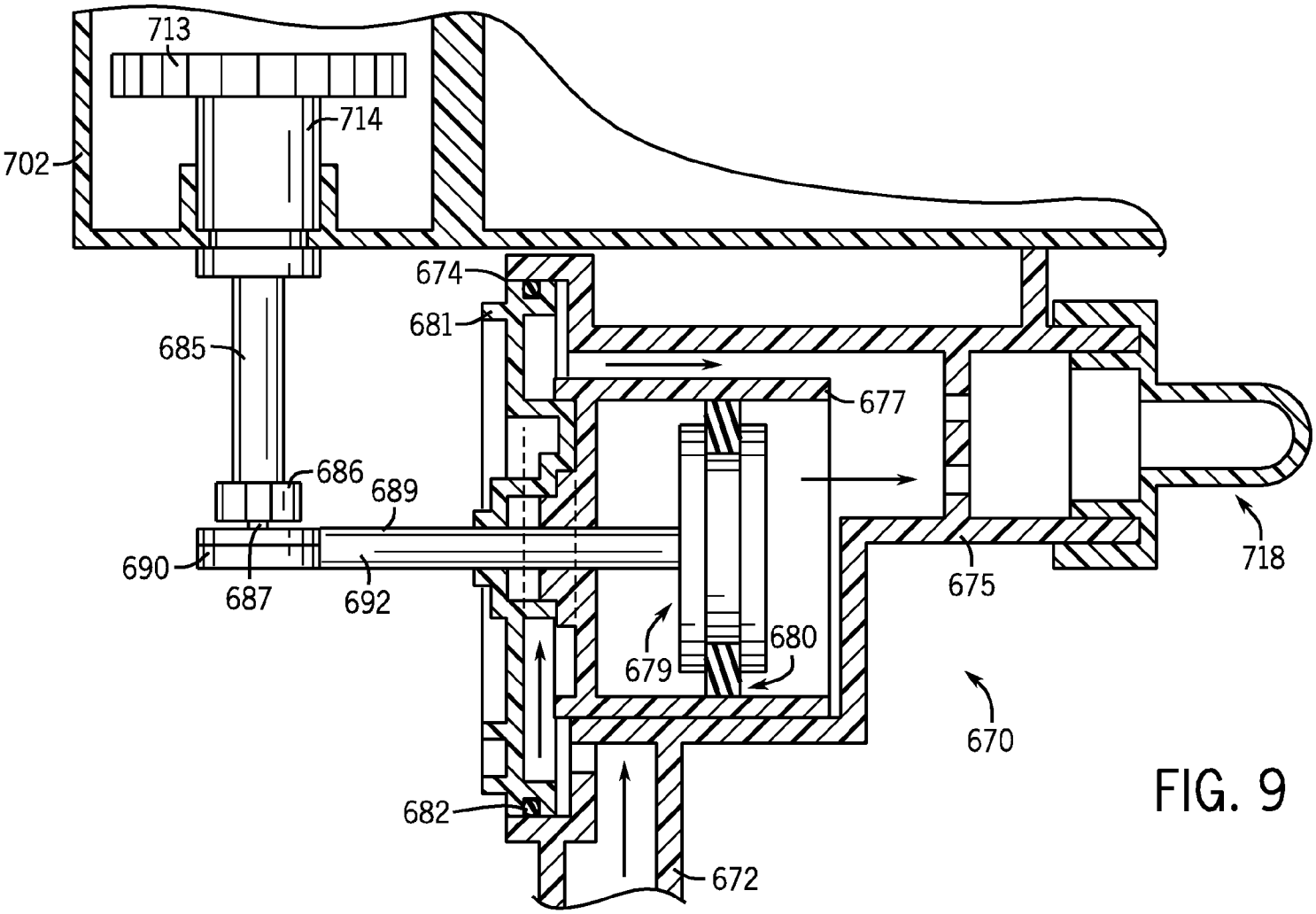
FIG. 9 is a cross-sectional view taken along line 9-9 of FIG. 8.
Figure 10:
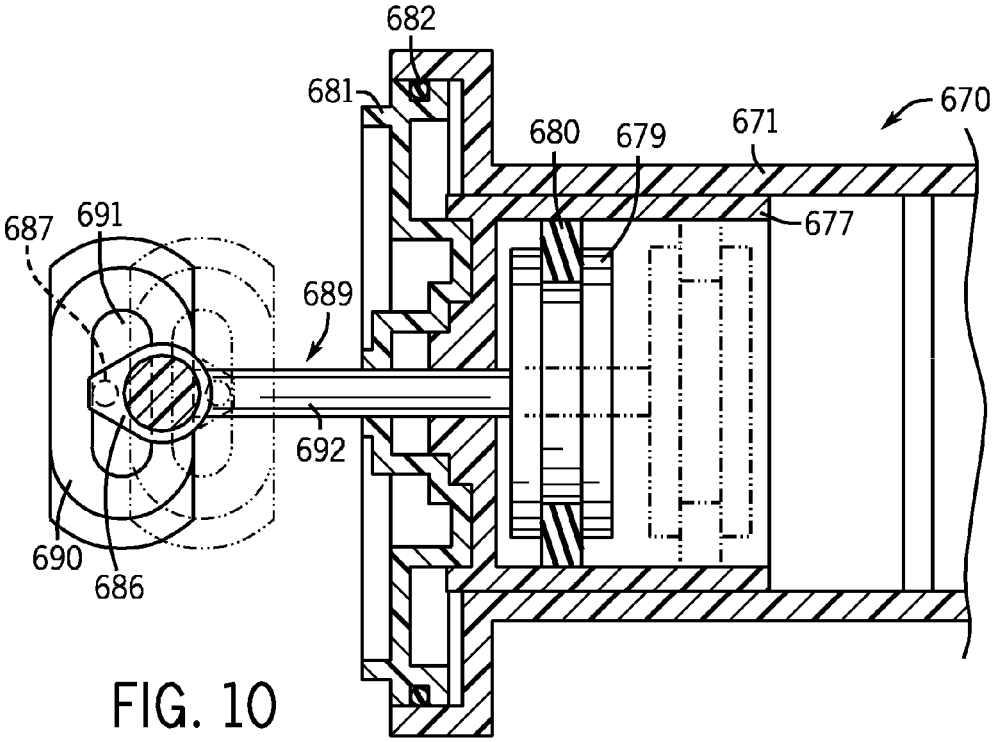
FIG. 10 is a cross-sectional view taken along line 10-10 of FIG. 8.

Referring now to FIGS. 7, 9 and 10, the sprayer 610 also includes a pump 670. While the illustrated pump 670 is a piston pump, other types of pump such as diaphragm pump, a peristaltic pump, or a gear pump can be used in the sprayer 610. The pump 670 includes a pump housing 671 having an inlet conduit 672, an open end 674, and an outlet conduit 675. A one way check valve is provided upstream of the inlet conduit 672. The one way check valve prevents liquid from flowing away from the inlet conduit 672 such that the pump remains primed and liquid does not flow back into the bottle 616. Hollow tubing 653 places the first tubular conduit 635 of the bottle coupler 630 and the inlet conduit 672 of the pump 670 in fluid communication. A pump cylinder 677 is located in the pump housing 671 as shown in FIGS. 9 and 10. A piston 679 reciprocates in the pump cylinder 677, and a piston seal 680 assures a sealing fit against the inner surface of the pump cylinder 677 during operation of the pump 670. A cover 681 closes off the open end 674 of the pump 670 with an O-ring 682 providing a fluid tight seal. The pump 670 includes a pump drive shaft 685 having an eccentric 686 with a downwardly extending pin 687. The pump 670 also includes a push rod 689 having an oblong end 690 with an opening 691 and having a stem 692 that connects the oblong end 690 with the piston 679.

Figure 8:
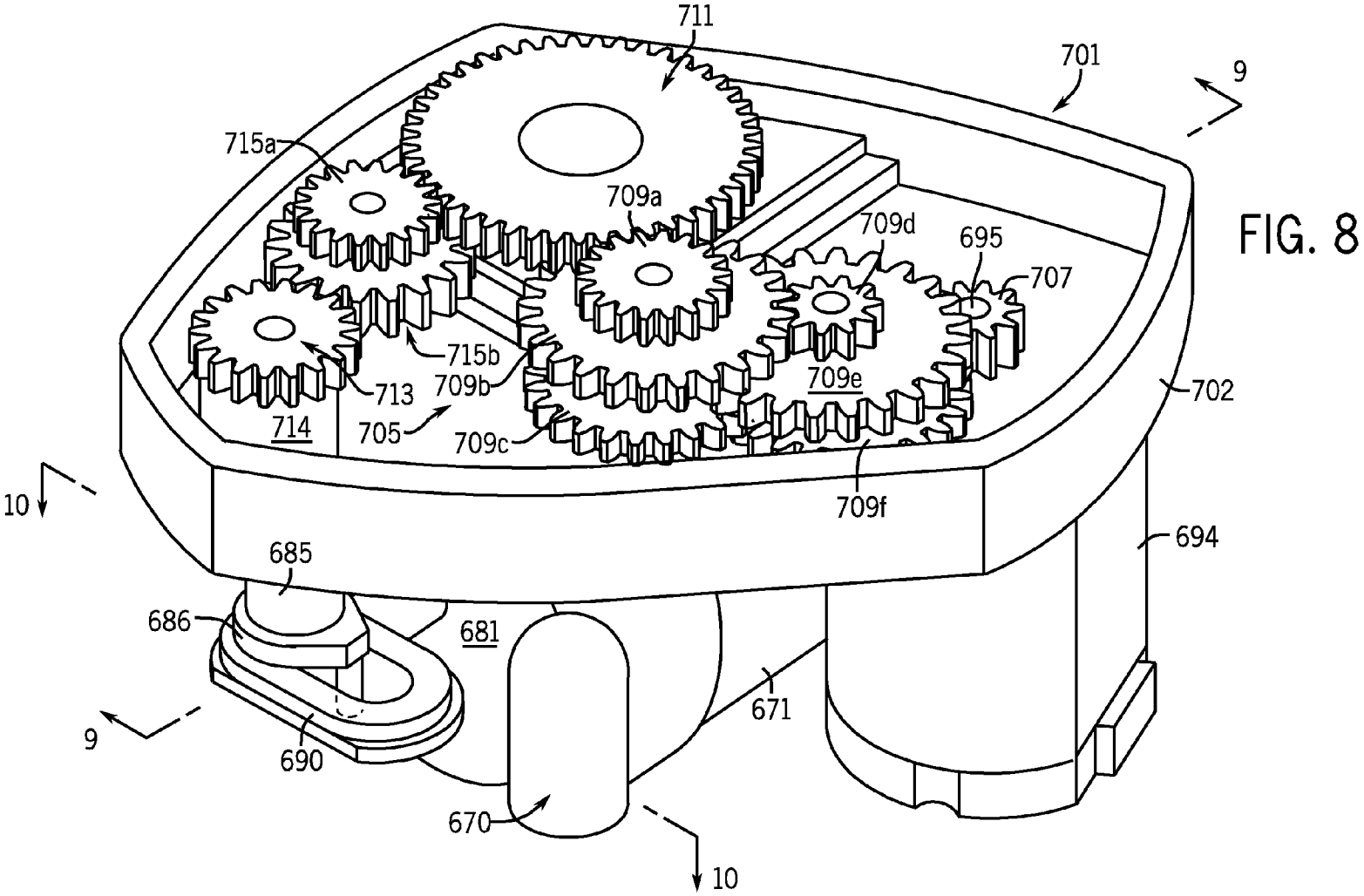
FIG. 8 is a perspective view of the motor, pump, and gear box assembly (with the upper gear case section removed) of the automated sprayer of FIG. 7.

Looking at FIGS. 7 and 8, the pump 670 has a direct current motor 694 having a single drive shaft 695. Suitable wiring (not shown) places the motor 694 in electrical communication with a controller. Wiring (not shown) also places the batteries in the battery compartments 625*a*, 625*b* in electrical communication with the controller. Wiring (not shown) also places the actuator button 659 in electrical communication with the controller. The functioning of the controller will be described below.

Referring now to FIGS. 7 and 8, the sprayer 610 also includes a gear box assembly 701 for transmitting mechanical power from the motor 694 to the pump 670. The gear box assembly 701 includes a case having a lower case section 702 and a mating upper case section 703. A gear drive train 705 is housed in the case. Looking at FIG. 8, the gear drive train 705 includes a pinion gear 707 coupled to the drive shaft 695 of the motor 694. Gears 709*a*, 790*b*, 709*c*, 709*d*, 709*e* and 709*f* transmit rotation of the pinion gear 707 to a drive gear 711. The gear drive train 705 also includes a pump drive gear 713 that is coupled to a shaft 714. Gears 715*a*, 715*b* transmit rotation from the drive gear 711 to the pump drive gear 713. Hollow tubing 718 (see FIG. 9) connects the fluid pathway 231 and the outlet conduit 675 of the pump 670 to place the fluid pathway 231 and the pump 670 in fluid communication. The drive gear 711 may also be coupled to suitable linkage for rotating the nozzle 222. The motor 223 may also be used for rotating the nozzle 222.

The gear box assembly 701 may include a different number of gears in meshing relationship, and axles can be operably connected to the gears. The gear box assembly 701 provides a linkage for transferring rotational movement of the drive shaft 695 of the motor 694 to the pump 670. While one example of a suitable gear/axle configuration is depicted in FIG. 8, it should be appreciated that any other suitable gears and linkages may be provided to transfer movement of the motor drive shaft 695 to components of the automated sprayer 610.

Having described the construction of the automated sprayer 610, the liquid flow path through the sprayer 610 can be explained. When the pump 670 is activated, liquid flows upward from the bottle 616 (though any dip tube if provided), through the neck 617, into the interior space of the bottle coupler 630, and through the first tubular conduit 635. Liquid exiting the first tubular conduit 635 flows through hollow tubing 653 past a one way check valve and into the inlet conduit 672 of the pump 670. Looking at FIG. 10, the push rod 689 and attached piston 679 reciprocate from the position shown in full lines to the position shown in broken lines. When the push rod 689 and attached piston 679 move from the position shown in broken lines to the position shown in full lines, the liquid is drawn into the pump cylinder 677 (the upward facing arrows and the top rightward facing arrow in FIG. 9 show this). When the push rod 689 and attached piston 679 move from the position shown in full lines to the position shown in broken lines in FIG. 10, the liquid is expelled from the pump cylinder 677 (the lower rightward facing arrow in FIG. 9 show this). The liquid then enters the hollow tubing 718 after passing through the outlet conduit 675 of the pump 670. After passing through the tubing 718, the liquid enters the fluid pathway 231. The liquid flows through the fluid pathway 231 and then into the nozzle assembly 220 thereby spraying liquid from the sprayer 610 onto the walls of the toilet bowl 250.

Figure 12:
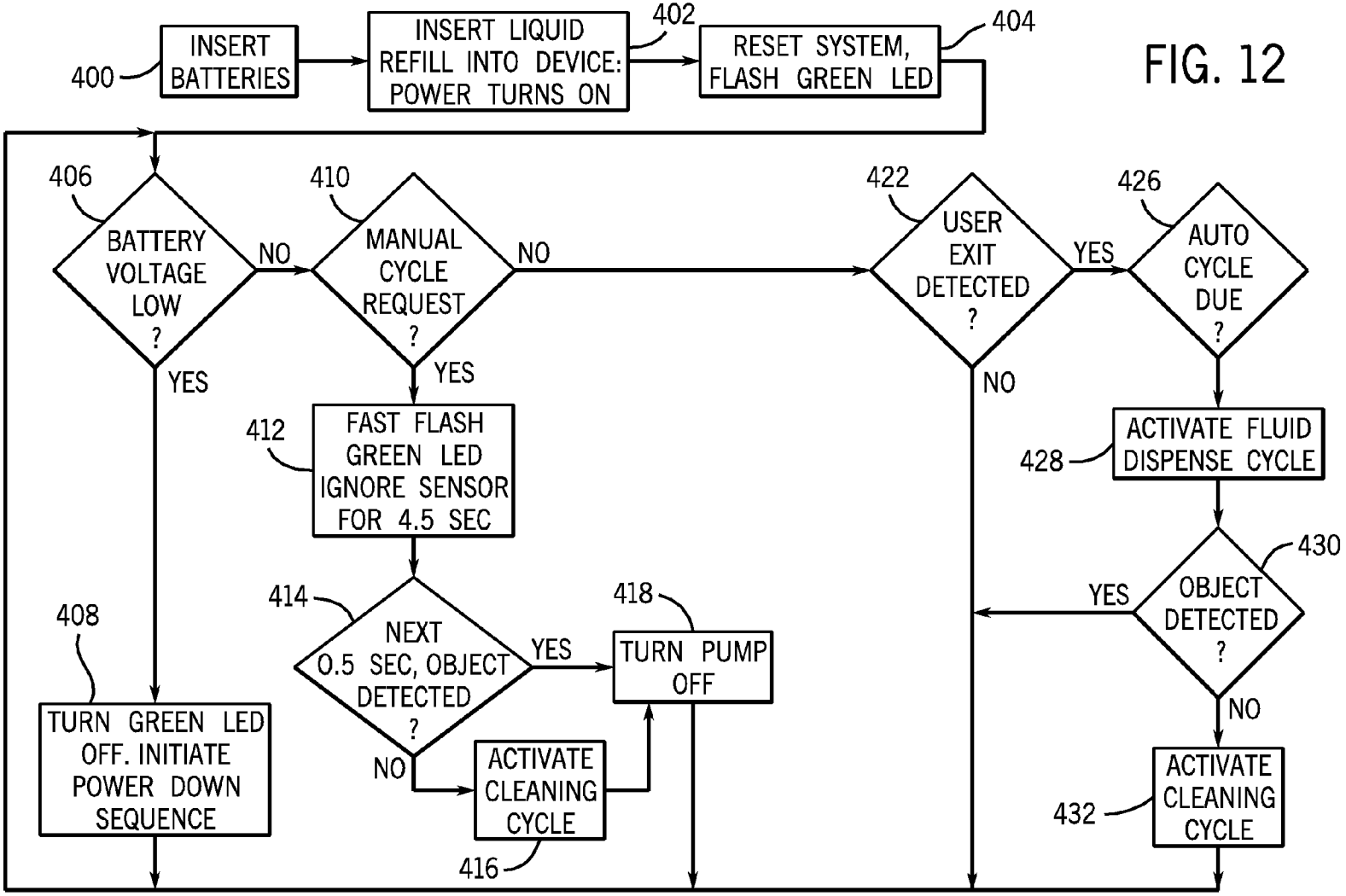
FIG. 12 is a functional flow diagram of the steps in an example operating method for the toilet bowl cleaning device of FIG. 8.

Having described the components and fluid flow path of the automated sprayer 610, operation of the sprayer 610 can be explained further. Referring to the functional flow diagram of FIG. 12, in a first step 400, a user inserts batteries into the battery compartments 625*a*, 625*b*. Battery compartments and their wiring to the controller are known in the art and therefore will not be explained further. In a second step 402, the bottle 616 is installed in the lower housing section 622 thereby completing a circuit to supply electrical power from batteries to the controller. This results in a reset of all controller system counters and fault conditions, and causes an LED to flash to indicate to the user that the sprayer 610 has properly powered up. The LED then remains on.

The software routine then advances to step 406. The sprayer 610 should function until the average battery voltage reaches a lower threshold voltage when the pump 670 is not running. In step 406, the controller checks the available battery voltage. If the battery voltage is below a predetermined value, a low voltage shutdown occurs at step 408 prior to controller microprocessor loss. In step 408, the LED is turned off and a power down sequence occurs. If the battery voltage is at or above a predetermined value, the routine proceeds to step 410.

At step 410, the controller responds to any manual cycle request from the pressing of the actuator button 659. If the actuator button 659 has been pressed, the routine advances to step 412. The manual cycle will dispense cleaning solution 5 seconds after the depression and release of the actuator button 659 providing there are no objects (e.g., people or pets) on or near the toilet bowl as detected by the sensor 24. At step 412, the LED will flash after the actuator button 659 has been pressed, and the controller will ignore the sensor 24 for 4.5 seconds (which allows a person to leave the area after the actuator button 659 has been pressed). At step 414, the controller receives signals from a sensing circuit of the sensor 24. If no signal is received by the controller from the sensor 24 that indicates the presence of an object near the toilet bowl, the routine proceeds to step 416 in which the controller provides electrical current to the motor 694 to deliver fluid to the nozzle assembly 220 to be dispensed onto the inside surface of the toilet bowl as described above. The controller can provide electrical current to the motor 694 for any selected time period depending on the amount of fluid that is desired to be dispensed onto the inside surface of the toilet bowl. One non-limiting example of a pumping time period is 1 second after which the routine moves to step 418. If a signal is received in step 414 by the controller from the sensor 24 that indicates the presence of an object near the toilet bowl 250, the routine proceeds to step 418 in which the controller refrains from providing electrical current to the motor 694. After step 418, the routine proceeds back to step 406.

When step 406 indicates that the battery voltage is not low and step 410 indicates that a manual cycle request has not been initiated by pressing the actuator button 659, the routine proceeds to step 422. At step 422, the controller checks the sensor 24 to determine if a user has entered the region of the toilet bowl and then exited the region of the toilet bowl. If no exit is detected, the routine proceeds back to step 406.

If a user has exited the area of the toilet bowl, at step 426, the controller indicates that an automatic dispensing is to occur, and the routine proceeds to step 428. During step 428, the controller also performs step 430 in which the controller monitors signals from the sensor 24. If the signals from the sensor 24 indicate the presence of an object near the toilet bowl, the routine proceeds back to step 406. If no signals from the sensor 24 indicate the presence of an object near the toilet bowl, the controller proceeds to step 432 in which current is provided to the motor 694 to deliver fluid to the nozzle assembly 220 to be dispensed onto the inside surface of the toilet bowl as described above. The routine proceeds back to step 406.

In an alternative control program, step 422 is removed and at step 426, the controller checks the time count of an automatic discharge timer that was started on the reset of all controller system counters and fault conditions. If the time count of the automatic discharge timer indicates that an automatic dispensing is not yet to occur, the routine proceeds back to step 406. If the time count of the automatic discharge timer indicates that an automatic dispensing is to occur (e.g., an eight hour dispensing interval has been reached), the routine proceeds to step 428. During step 428, the controller also performs step 430 in which the controller monitors signals from the sensor 24. If the signals from the sensor 24 indicate the presence of an object near the toilet bowl, the routine proceeds back to step 406. If no signals from the sensor 24 indicate the presence of an object near the toilet bowl, the controller proceeds to step 432 in which current is provided to the motor 694 to deliver fluid to the nozzle assembly 220 to be dispensed onto the inside surface of the toilet bowl as described above. At step 432, the timer may be restarted on a second automatic discharge that will take place 8 hours from the end of the pumping time period. The routine proceeds back to step 406.

With regard to fastening, mounting, attaching or connecting components of the present invention to form the automated sprayer or components thereof, in accordance with some embodiments of the present invention, unless specifically described otherwise, such are intended to encompass conventional fasteners such as screw threads, threaded connectors, snap rings, detent arrangements, clamps, pins and the like. Components may also be connected by adhesives, glues, welding, ultrasonic welding, and friction fitting or deformation, if appropriate, and appropriate liquid and/or airtight seals or sealing devices may be used. Any electronic portions in accordance with the present invention may use conventional, commercially available electronic components, connectors and devices such as suitable wiring, connectors, printed circuit boards, microchips, sensors, inputs, outputs and the like. Electrical and other components of the invention may be isolated, contained and/or sealed in one or more water and/or fluid-tight chambers, coatings or structures based on environmental or dispensing requirements (e.g., the place of dispensing, the substance to be dispensed, etc.), for example, to prevent or minimize corrosion, leakage, contamination, etc. Unless specifically otherwise disclosed or taught, materials for making the present invention and/or components thereof may be selected from appropriate materials such as metal, metallic alloys, ceramics, plastics and the like, and appropriate manufacturing or production methods including casting, pressing, extruding, molding and machining maybe used.

In the foregoing description, embodiments of the present invention, have been presented for the purpose of illustration and description. They are not intended to be exhaustive or to limit the invention to the precise forms disclosed. Obvious modifications or variations are possible in light of the above teachings. The embodiments were chosen and described to provide the best illustrations of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

INDUSTRIAL APPLICABILITY

The present invention provides a sprayer for automatically spraying the walls of an enclosure, such as a toilet bowl, and the like.

What is claimed is:

1. A device for spraying an inner surface of a wall of an enclosure with a fluid, the device comprising:

a reservoir for the fluid;

a nozzle assembly including a nozzle through which the fluid can be sprayed on the inner surface of the wall of the enclosure, the nozzle assembly including mounting structure for attaching the nozzle near the inner surface of the wall of the enclosure, the nozzle assembly including a deflector shield wherein the deflector shield directs fluid through the nozzle in a laminar flow;

a fluid conduit in fluid communication with the reservoir and the nozzle;

a pump for delivering fluid from the reservoir through the fluid conduit and to the nozzle when the pump is activated;

a controller in electrical communication with the pump, the controller executing a stored program to activate and deactivate the pump; and a vent assembly in fluid communication with an interior space of the reservoir, the vent assembly comprising a valve wherein the valve opens by negative pressure that develops as fluid is withdrawn from the reservoir and closes when the pressure in the reservoir has equalized.

2. The device of claim 1 wherein the valve is an actuator assist valve.

3. The device of claim 1 wherein the controller activates the pump based on a scheduled spraying time stored in the controller.

4. The device of claim 1 wherein the controller activates the pump when a manual actuator is actuated.

5. The device of claim 1 wherein fluid flowing into the nozzle assembly and out of the nozzle effects rotation of the nozzle.

6. The device of claim 1 wherein the nozzle assembly further comprises:

a motor to effect rotation of the nozzle.

7. The device of claim 1 wherein the enclosure is a toilet.

8. A device for spraying an inner surface of a wall of a toilet bowl with a fluid, the device comprising:

a reservoir for the fluid;

a nozzle assembly including a nozzle through which the fluid can be sprayed on the inner surface of the wall of the toilet bowl, the nozzle assembly including mounting structure for attaching the nozzle near the inner surface of the wall of the toilet bowl, the nozzle assembly including a deflector shield wherein the deflector shield directs fluid through the nozzle in a laminar flow;

a fluid conduit in fluid communication with the reservoir and the nozzle;

a pump for delivering fluid from the container through the fluid conduit and to the nozzle when the pump is activated;

a pressure sensor disposed on the nozzle assembly for detecting unseating of a person from the toilet; and a controller in electrical communication with the pump, the sensor, and a source of electricity, wherein the controller executes a stored program to:

(i) monitor electrical signals from the sensor to determine when a person unseats from the toilet; and (ii) if the controller determines that a person has unseated from the toilet, activate the pump for a pump cycle time for delivering fluid from the reservoir through the fluid conduit and to the nozzle.

9. The device of claim 8 where the sensor is an infrared sensor that emits an actuation signal upon a predetermined change in light intensity.

10. The device of claim 8 wherein the controller activates the pump when a manual actuator is actuated.

11. The device of claim 8 wherein force of the fluid flowing into the nozzle assembly and out of the nozzle effects rotation of the nozzle.

12. The device of claim 8 wherein the nozzle assembly comprises:

a motor to effect rotation of the nozzle.

13. A device for spraying an inner surface of a toilet bowl with a fluid, the device comprising:

a reservoir for the fluid;

a pressure sensor disposed on the nozzle assembly for detecting unseating of a person from the toilet;

a nozzle assembly including a nozzle through which the fluid can be sprayed on the inner surface of the toilet bowl, the nozzle assembly including mounting structure for attaching the nozzle near the inner surface of the toilet bowl, the nozzle assembly including a deflector shield wherein the deflector shield directs fluid through the nozzle in a laminar flow;

a pump for delivering fluid from the reservoir through the fluid conduit and to the nozzle when the pump is activated; and a controller in electrical communication with the pump, the controller executing a stored program to activate and deactivate the pump, wherein the nozzle assembly further includes a housing connected to the mounting structure, the housing containing the pump and the controller.

14. The device of claim 13 wherein:

the controller activates the pump based on a scheduled spraying time stored in the controller.

15. The device of claim 13 wherein:

the controller activates the pump when a manual actuator is actuated.

16. The device of claim 13 wherein:

force of the fluid flowing into the nozzle assembly and out of the nozzle effects rotation of the nozzle.

* * * * *